United States Patent [19]

Mikajiri

[11] 4,319,438

[45] Mar. 16, 1982

[54] SHAPED FRAME MATERIAL FOR USE IN FORMING PIT FRAMES

[75] Inventor: Kiichiro Mikajiri, Ooita, Japan

[73] Assignee: Yugen Kaisha Shinnihon Seisakusho, Ooita, Japan

[21] Appl. No.: 149,111

[22] Filed: May 8, 1980

[51] Int. Cl.[3] ..... E04B 5/48

[52] U.S. Cl. ..... 52/221; 220/3.4

[58] Field of Search ..... 52/221; 138/92, 103; 220/3.3, 3.4

[56] References Cited

U.S. PATENT DOCUMENTS

| | | | |
|---|---|---|---|
| 3,262,238 | 7/1966 | Fork | 52/221 |
| 3,318,476 | 5/1967 | Clark | 52/221 X |
| 3,494,381 | 2/1970 | Fork | 52/221 |
| 3,715,844 | 2/1973 | Breading | 52/221 |

*Primary Examiner*—J. Karl Bell

*Attorney, Agent, or Firm*—Armstrong, Nikaido, Marmelstein & Kubovcik

[57] ABSTRACT

A multi-purpose shaped frame material for use in forming pit frames, which can be used in three modes in accordance with the structure of a pit, which is used for wiring, piping, draining and ventilation, the material of which a lid member is made, and the thickness of the lid member. The shaped frame material comprises a first support member having first and second flat supporting surfaces on the front and rear sides thereof, respectively; a second support member formed integrally with and extended at right angles from one end portion of the first support member, and having a substantially cross-sectionally C-shaped lengthwise-extended recess in the front side thereof and a third flat supporting surface on the rear side thereof; and a vertical edge member formed integrally with and extended at right angles from the other end portion of the first support member, the height of the vertical edge member measured from the first supporting surface, the height of the first support member measured from the second supporting surface and the height of the second support member measured from the third supporting surface being differnt from one another.

5 Claims, 4 Drawing Figures

SHAPED FRAME MATERIAL FOR USE IN FORMING PIT FRAMES

BACKGROUND OF THE INVENTION

The present invention relates to a shaped frame material for use in forming a pit frame attached to the inner surfaces of a pit.

Buildings generally have a pit under the floor or ground surface, for use in wiring, piping, draining and ventilation. Such a pit is fortified with a pit frame attached to the inner surfaces thereof. A lid member is placed on the edge of the open end portion of the pit fringed with a part of the pit frame, so that the top open end portion of the pit is covered with the lid member. Since fit frames vary in size and shape depending upon the structure of a pit, the material of which a lid member to be used is made, and the thickness of the lid member, it is necessary that several types of pit frames be prepared.

SUMMARY OF THE INVENTION

Therefore, an object of the present invention is to provide a shaped frame material for use in forming pit frame, which can be used in three modes according to the structure of a pit, the material of which a lid member to be used is made, and the thickness of the lid member.

To this end, the present invention provides a shaped frame material for use in forming a pit frame, comprising a first support member having first and second flat supporting surfaces on the front and rear sides thereof, respectively; a second support member formed integrally with and extended at right angles from one end portion of the first support member, and having a substantially cross-sectionally C-shaped lengthwise-extended recess in the front side thereof and a third flat supporting surface on the rear side thereof; and a vertical edge member formed integrally with and extended at right angles from the other end portion of the first support member, the height of the vertical edge member measured from the first supporting surface, the height of the first support member measured from the second supporting surface and the height of the second support member measured from the third supporting surface being different from one another.

The above and other objects as well as advantageous features of the invention will become apparent from the following description of the preferred embodiment taken in conjunction with the accompanying drawings.

BRIEF DESCRIPTION OF THE INVENTION

DESCRIPTION OF THE PREFERRED EMBODIMENT

Figure 1:
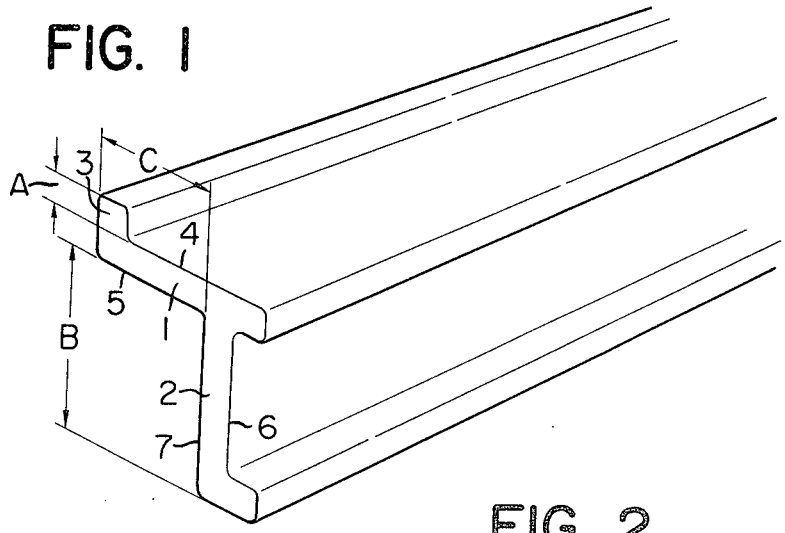
FIG. 1 is a perspective view of a shaped frame material embodying the present invention.

An embodiment of the present invention will be described with reference to the accompanying drawings.

A frame material according to the present invention is formed by subjecting a light metal, such as aluminum, or some other kind of metal to drawing or casting, and consists of a first support member 1, a second support member 2 and an edge member 3. The first support member 1 is horizontally formed and has first and second flat supporting surfaces 4, 5 on the front and rear surfaces thereof, respectively. The second support member 2 is formed integrally with and extended at right angles from one end portion of the first support member. The second support member 2 has a substantially cross-sectionally C-shaped lengthwise-extended recess 6 in the front side thereof, and a third flat supporting surface 7 on the rear side thereof. The edge member 3 is formed integrally with and extended at right angles from the other end portion of the first support member.

The height A of the edge member 3 measured from the first supporting surface 4, the height B of the second support member 2 measured from the second supporting surface 5, and the height C of the first support member 1 measured from the third supporting surface 7 are different from one another.

A shaped frame material formed as described above is set in a pit P as a pit frame F so as to fringe the top open end portion of the pit P.

Figure 2:
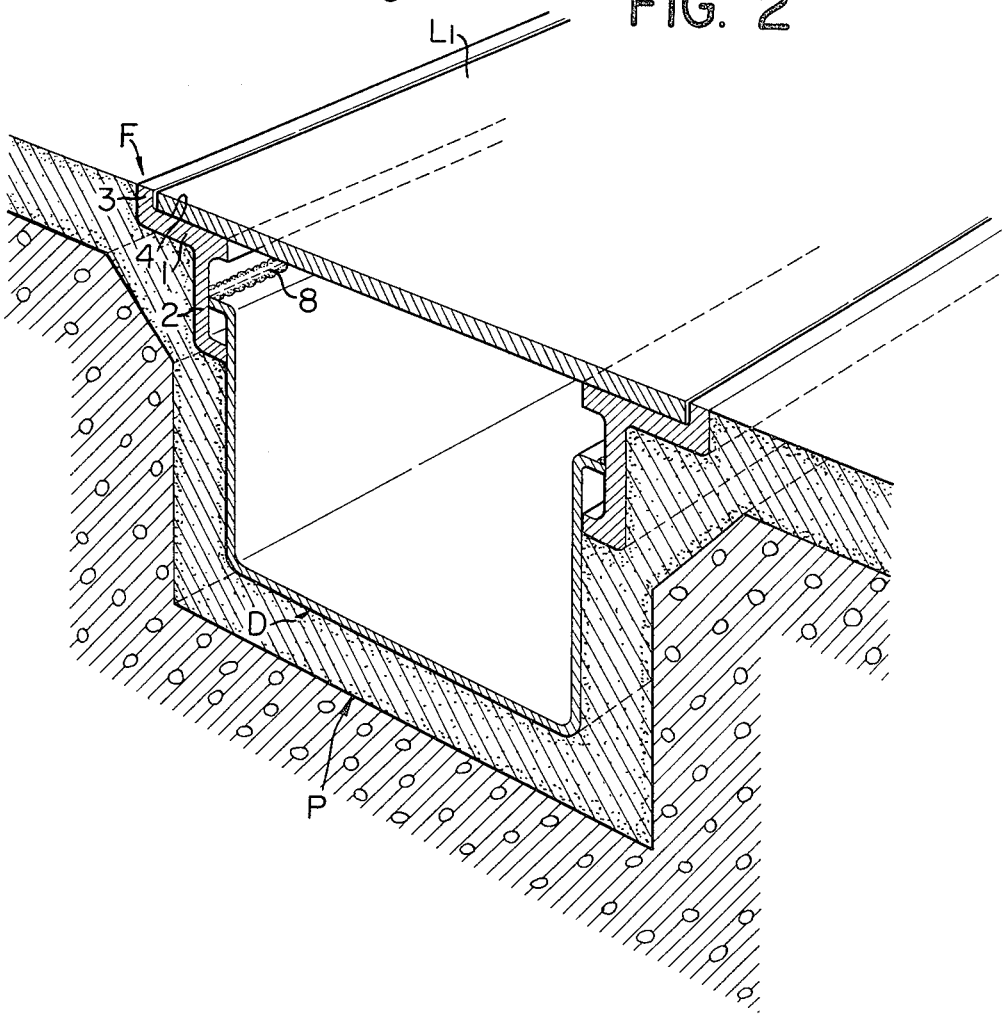
FIG. 2 is a perspective view of an example of a pit frame formed by using the frame material shown in FIG. 1.

A first example of a pit frame in which a frame material according to the present invention will be described with reference to FIG. 2.

In this example, the first supporting surface 4 of the first support member 1 of a shaped frame material referred to above is used as the supporting surface for a lid member $L_1$. In this case, the frame material is set in the top open end portion of a pit P such that the first support member 1 is in an upper position with the recess 6 in the second support member 2 directly inwardly, to form a pit frame F. A cross-sectionally U-shaped duct D is welded at its upper end portion 8 to the surface of the C-shaped recess 6 in the second support member 2. Since the welded portion 8 is within the recess 6 or not projected inwardly from the end surface of the second support member 2, the welded portion 8 is never contacted by wires and pipes arranged in the duct D. The lid member $L_1$ for covering the pit P placed on the first supporting surface 4 of the first support member 1 has a thickness substantially equal to the height A, and is made of a comparatively thin plate of steel or a light metal.

Figure 3:
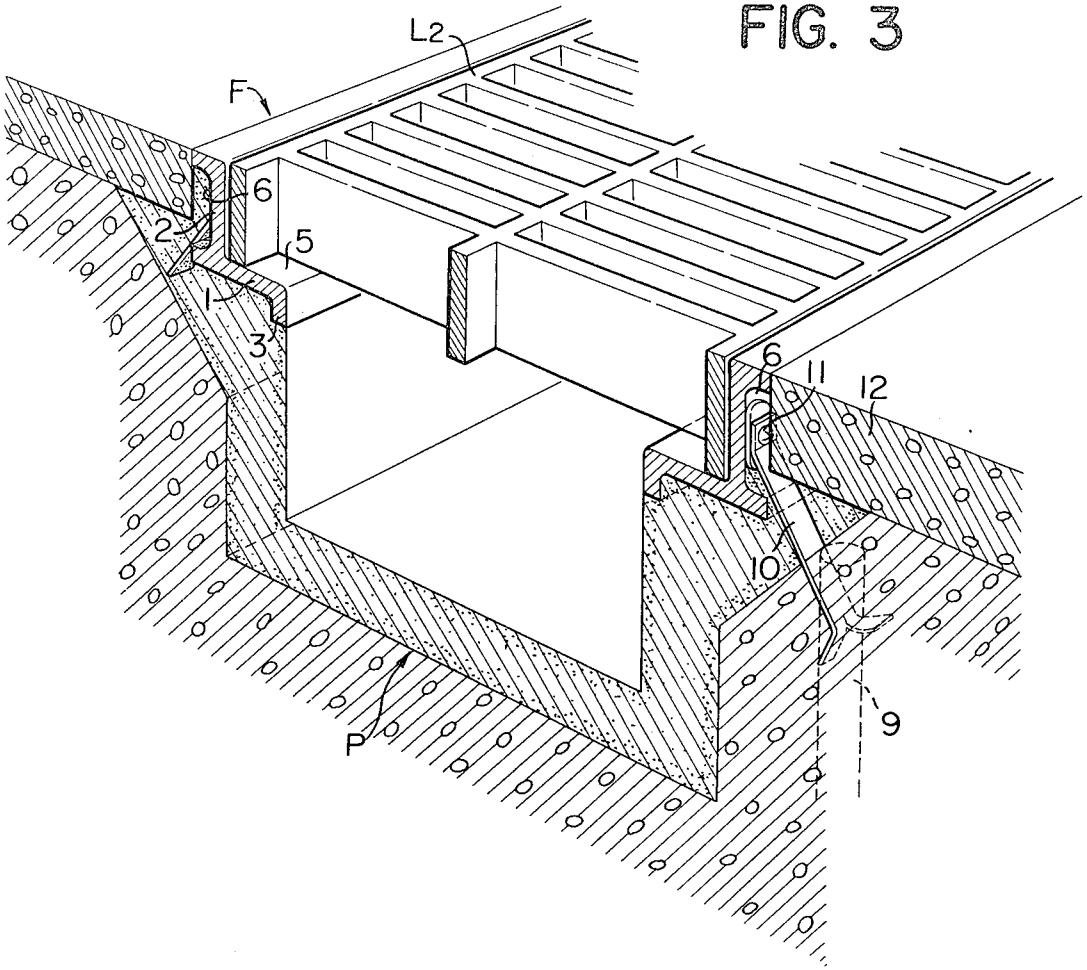
FIG. 3 is a perspective view of another example of a pit frame formed by using the frame material shown in FIG. 1.

A second example of a pit frame in which a frame material according to the present invention will be described with reference to FIG. 3.

In this example, the second supporting surface 5 of the first support member 1 of a shaped frame material referred to above is used as the supporting surface for a lid member $L_2$. In this case, the frame material is set in the top open end portion of a pit P such that the second support member 2 is in an upper position with the recess 6 in the second support member 2 directed outwardly, to form a pit frame F. An anchor 10, which is welded at its base end to a joint rod 9, is attached at the front end thereof to the surface of the recess 6 in the second support member 2 with an anchor bolt 11. The anchor bolt 11 can be driven into the surface of the recess 6 such that the head portion of the anchor bolt 11 is inner than the end surface of the second support member 2. Accordingly, when a member 12 surrounding the pit frame F and made of stone is used, it is unnecessary to form in the member 12 a recess for enclosing the anchor bolt 11.

This allows the physical strength of the stone, which is comparatively fragile, to be retained as it is, and the member 12 can be prevented from being broken or cracked. The lid member $L_2$ placed on the second supporting surface 5 of the first support member 1 has a thickness substantially equal to the height B referred to above. In this example, a comparatively thick lid member, such as a lattice lid member and a mortar lid member, is suitably used.

Figure 4:
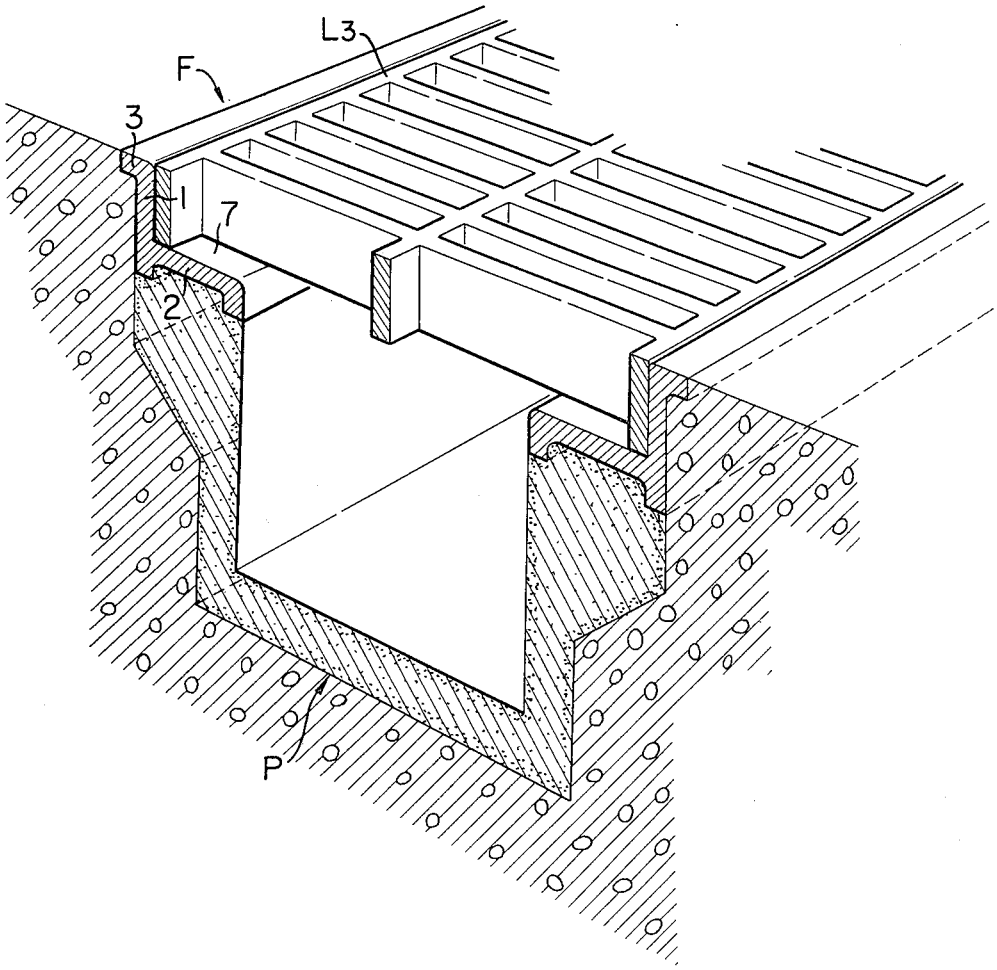
FIG. 4 is a perspective view of still another example of a pit frame formed by using the frame material shown in FIG. 1.

A third example of a pit frame in which a frame material according to the present invention will be described with reference to FIG. 4.

In this example, the third supporting surface 7 of the second support member 2 is used as the supporting surface for a lid member $L_3$. In this case, the frame material is set in the top open end portion of a pit P such that the first support member 1 is in an upper position with the recess 6 in the second support member 2 directed downwardly, to form a pit frame F. The lid member $L_3$ placed on the third supporting surface 7 has a thickness substantially equal to the height C referred to above.

The pit frames F in the first to third examples are different in the height measured from the lid member supporting surface to the upper end surface of the pit frame, so that lid members of different thicknesses and structures can be placed on the pit frame F.

With a shaped frame material according to the present invention described above, three modes of pit frames, in which the lid member supporting surfaces are different in height, can be formed. Moreover, the C-shaped recess 6 formed in the pit frame serves to protect, in one mode of use of the frame material, a welded portion 8 of a duct D. In another mode of use of the frame material, in which an anchor 10 is attached at its one end to the surface of the recess 6, it is unnecessary to specially process a stone member, which surrounds the pit frame F, so as to allow the anchor to be attached properly to the pit frame F. This allows the stone member to retain its physical strength.

The present invention is not, of course, limited to the above-described embodiment; it may be modified in various ways within the scope of the appended claims.

What is claimed is:

1. A shaped frame material for use in forming a pit frame, comprising: a first support member having first and second flat supporting surfaces on the front and rear sides thereof, respectively; a second support member formed integrally with and extended at right angles from one end portion of said first support member, and having a substantially cross-sectionally C-shaped lengthwise-extended recess in the front side thereof and a third flat supporting surface on the rear side thereof; and a vertical edge member formed integrally with and extended at right angles from the other end portion of said first support member, the height of said vertical edge member measured from said first supporting surface, the height of said first support member measured from said second supporting surface and the height of said second support member measured from said third supporting surface being different from one another; any of the first, second and third flat supporting surfaces being usable to form three different kinds of pit frames whereby the first, second or third flat supporting surface is able to support three kinds of lid members of different thickness with the upper surface of said lid members being held flush with the upper surface of one of said first, second and third flat supporting surfaces.

2. A shaped frame material according to claim 1, wherein: said first support member is disposed horizontally and said second support member extends vertically and downwardly from said first support member, such that said first flat supporting surface of said first support member is directed upwardly to support a lid member with an upper surface of the latter being held flush with an upper surface of said vertical edge member which extends vertically from said first support member.

3. A shaped frame material according to claim 2, wherein: a pit-forming member is connected with said second support member at its C-shaped recess.

4. A shaped frame material according to claim 1, wherein: said first support member is disposed horizontally and said second support member extends vertically and upwardly from said first support member, such that said second flat supporting surface of said first support member is directed upwardly to support a lid member with an upper surface of the latter being held flush with an upper surface of said second support member.

5. A shaped frame material according to claim 1, wherein: said second support member is disposed horizontally and said first support member extends vertically and upwardly from said second support member, such that said third flat suporting surface of said second support member is directed upwardly to support a lid member with an upper surface of the latter being held flush with an upper surface of said first support member.

* * * * *